United States Patent [19]

Savart et al.

[11] Patent Number: 4,481,883

[45] Date of Patent: Nov. 13, 1984

[54] LOW-BLADE INKING MECHANISM WITH DETACHABLE INK DUCT TROUGHS

[75] Inventors: Bernard Savart, Saint-Maur; Alain Ducournau, Basse Goulaine, both of France

[73] Assignee: Creusot-Loire, Paris, France

[21] Appl. No.: 493,490

[22] Filed: May 11, 1983

[30] Foreign Application Priority Data

Jun. 4, 1982 [FR] France ..... 82 09775

[51] Int. Cl.[3] ..... B41F 1/46

[52] U.S. Cl. ..... 101/363; 101/365

[58] Field of Search ..... 101/350, 363, 365, 351, 101/364, 148, 207

[56] References Cited

U.S. PATENT DOCUMENTS

| | | | |
|---|---|---|---|
| 3,116,688 | 1/1964 | Ward, Jr. et al. | 101/350 |
| 3,227,080 | 1/1966 | Hill | 101/350 X |
| 3,257,943 | 6/1966 | Shank | 101/350 X |
| 3,696,743 | 10/1972 | Johne et al. | 101/365 |
| 3,978,788 | 9/1976 | Cappel et al. | 101/363 |
| 4,050,380 | 9/1977 | Pfizenmaier | 101/365 |
| 4,058,058 | 11/1977 | Hantscho | 101/365 |
| 4,406,224 | 9/1983 | Hajek | 101/363 |

FOREIGN PATENT DOCUMENTS

| | | | |
|---|---|---|---|
| 1290154 | 3/1969 | Fed. Rep. of Germany | 101/363 |

*Primary Examiner*—Edgar S. Burr
*Assistant Examiner*—Moshe I. Cohen
*Attorney, Agent, or Firm*—Pollock, Vande Sande & Priddy

[57] ABSTRACT

A low-blade type inking mechanism, comprising an ink duct roller (1) and an ink duct (4) carrying at least one detachable trough (7). The ink duct (4) is mounted on an axis (3) parallel to the axis of the roller (1) and rotatable about the latter so that the ink duct (4) can pivot about the roller (1) without the through (7) moving away from said roller (1), and pivot about the axis (3) on which it is mounted so that the trough (7) moves away from said roller (1). The mechanism is used in rotary printing presses, particularly for color printing.

4 Claims, 5 Drawing Figures

LOW-BLADE INKING MECHANISM WITH DETACHABLE INK DUCT TROUGHS

BACKGROUND OF THE INVENTION

The invention relates to an inking mechanism intended to be used in a printing press, for example an offset press.

A rotary printing press comprises a number of printing units each comprising a plate cylinder to which the ink is fed, through the intermediary of distributing rollers, from an ink duct roller. The ink duct roller is itself in contact with the ink contained in an ink duct trough. To prevent an irregular impression, the quantity of ink taken by the ink duct roller must be constant: to this end an ink duct blade is applied against the ink duct roller. Two types of ink ducts have been known for a long time: the high-blade ink ducts in which the blade is located above the ink duct roller, and the low-blade ink ducts in which the blade is located beneath the ink duct roller. The low-blade ink ducts may be preferred to the high-blade ink ducts because of their smaller volume and consequent lower cost.

PRIOR ART

The low-blade ink ducts currently comprise a trough which can be separated into a plurality of compartments, for example four, thus permitting the simultaneous printing of a plurality of pages. These compartments are generally filled with black ink, but if it is desired to perform color printing, it is necessary to be able to change the color of the ink contained in the various compartments. It may likewise be required for one compartment to be completely emptied of its ink, for example if one of the four pages is required to remain blank. In order to change the ink of a compartment, it is necessary to drain this compartment beforehand; this presents various disadvantages such as loss of time, non-recovery of drained ink, and having to perform a dirty operation.

On the other hand, since the high-blade ink duct troughs present the disadvantage that they cannot be separated into compartments, it is known to use high-blade ink ducts comprising detachable troughs placed on a fixed ink duct bracket. The trough withdrawn can thus be placed on standby with the ink which it contains until it is required for use again. However, although an ink duct with detachable troughs is easy to construct for a high-blade type ink duct, this is not so for the low-blade type ink ducts, in which the ink duct blade is located beneath the ink duct roller. Indeed, in this type of ink duct, the ink is kept between the ink duct blade and the ink duct roller and it is impossible to withdraw the trough without much of the ink running away as soon as the trough is no longer in contact with the ink duct roller.

SUMMARY OF THE INVENTION

This invention therefore seeks to overcome this disadvantage: it deals with a low-blade type ink duct in which it should be possible to withdraw the troughs without previously draining the ink.

More specifically, the invention relates to a low-blade type inking mechanism comprising an ink duct roller and an ink duct carrying at least one detachable trough. According to the invention, the ink duct is mounted on an axis parallel to the axis of the roller, this axis being rotatable about the roller so that the ink duct can on the one hand pivot about the roller without the trough moving away from said roller, and on the other hand pivot about the axis on which it is mounted so that the trough moves away from said roller.

The inking mechanism according to the invention is preferably equipped with means to rotate the axis of the ink duct about the axis of the roller between two positions, a so-called work position in which the ink contained in the trough of the ink duct wets the ink duct roller, and a position in which the end of the ink duct blade emerges from the ink contained in the ink duct trough.

In a preferred embodiment of the invention, the means of fixing the trough to the ink duct are adjustable to permit the permutation of different detachable troughs to different ink ducts.

BRIEF DESCRIPTION OF THE DRAWINGS

In order to be more fully understood, the invention will now be described with reference to a preferred embodiment, given solely by way of example and illustrated in the accompanying drawings.

FIG. 1 is a radial section of the mechanism, made at the level of a trough.

In all the figures, corresponding elements are designated by the same reference numerals.

DETAILED DESCRIPTION

Figure 1:
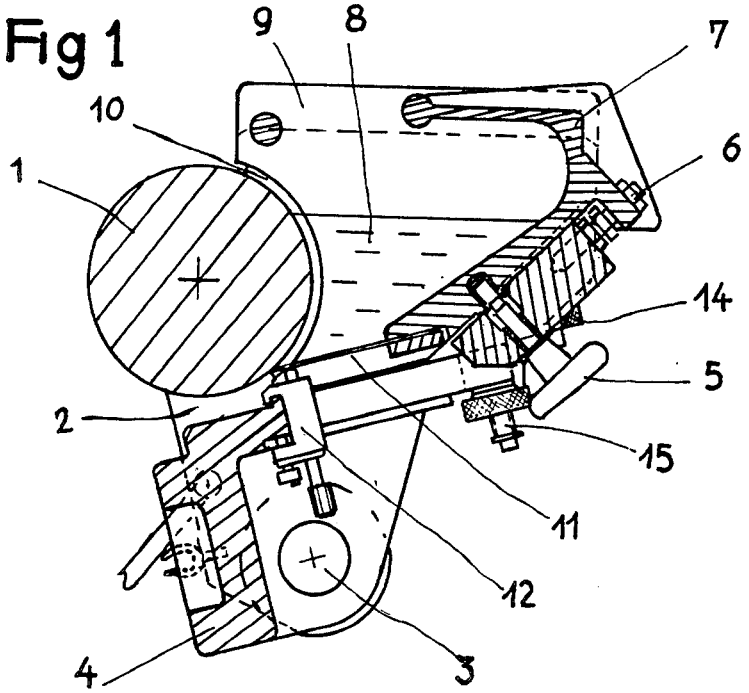
FIG. 1 shows the inking mechanism according to the invention in the work position, i.e., in a position in which the ink contained in the trough of the ink duct wets the ink duct roller so that the latter transmits the ink to the plate cylinder through the intermediary of other rollers (not shown). More specifically.

Reference is made first to FIG. 1.

FIG. 1 shows the ink duct roller 1 on which is mounted a bearing 2 fixed to the axis 3 of the ink duct 4. A trough 7 containing a quantity of ink 8 is fixed by means of screws 5 and 6 to the ink duct 4. The ink 8 is kept in the trough 7 by means of the lateral walls 9 of the trough, terminating in joints 10 which are applied against the ink duct roller 1, on the one hand, and by an ink duct blade 11, the edge of which is applied against the ink duct roller 1, on the other hand. The distance of the blade 11 relative to the ink duct roller 1 can be adjusted by means of a screw 12 fixed to the ink duct 4.

Figure 2:
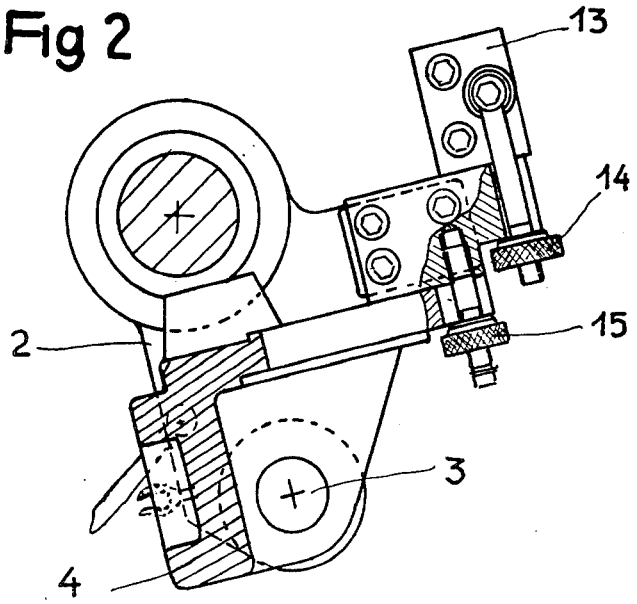
FIG. 2 shows the inking mechanism according to the invention in a position similar to that of FIG. 1, i.e., in the work position, but the section has been made at one of the two ends of the inking mechanism, i.e., at the level of one of the bearings mounted on the axis of the ink duct roller to support the ink duct.

FIG. 2 shows, more clearly than FIG. 1, the fixing of the bearing 2 to a fixed frame 13 through the intermediary of a screw 14. FIG. 2 likewise shows the fixing of the ink duct 4 to the bearing 2 by means of a screw 15.

Figure 3:
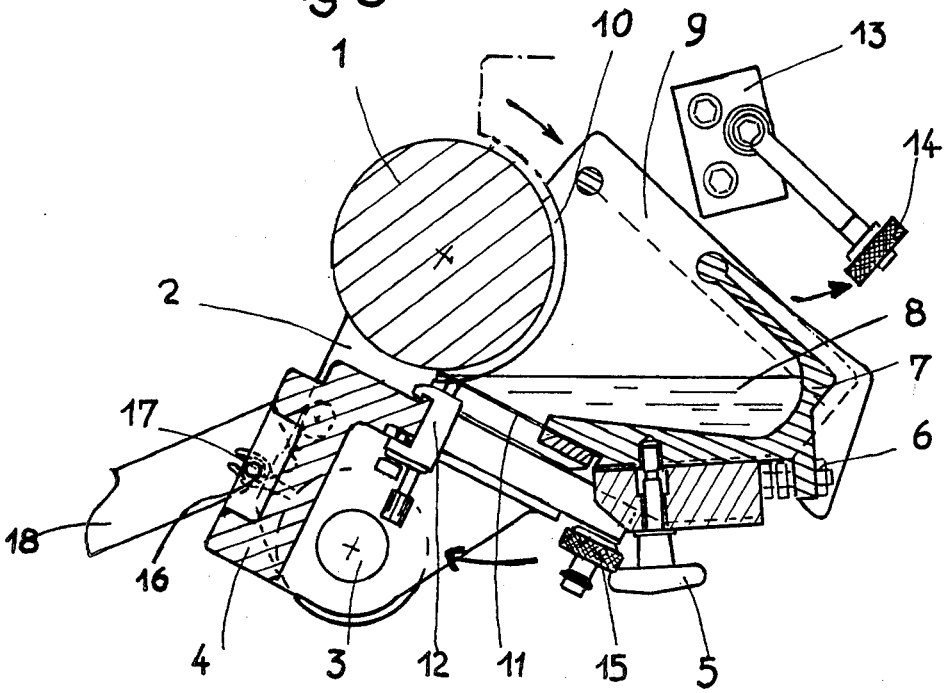
FIG. 3 is a figure similar to FIG. 1, after pivoting the axis of the ink duct about the axis of the roller.

Reference will now be made to FIG. 3. This figure is similar to FIG. 1. However, it differs from the latter in that, by acting upon the screw 14, the bearing 2 has been detached from the frame 13, then the bearing has been pivoted until it comes to be hooked by means of a clip 16 upon a pin 17, also fixed to the fixed frame 13. A jack 18, fixed at one end to the bearing 2 and at its other end to the fixed frame 13, has permitted this pivoting of the bearing 2 about the axis of the roller 1 to be effected. In this pivoting movement, the trough 7 of the ink duct 4 has remained in contact with the roller 1, thus preventing the ink 8 from escaping from the trough 7. In the position of FIG. 3, the end of the ink duct blade 11 emerges from the ink 8 contained in the trough 7.

Figure 4:
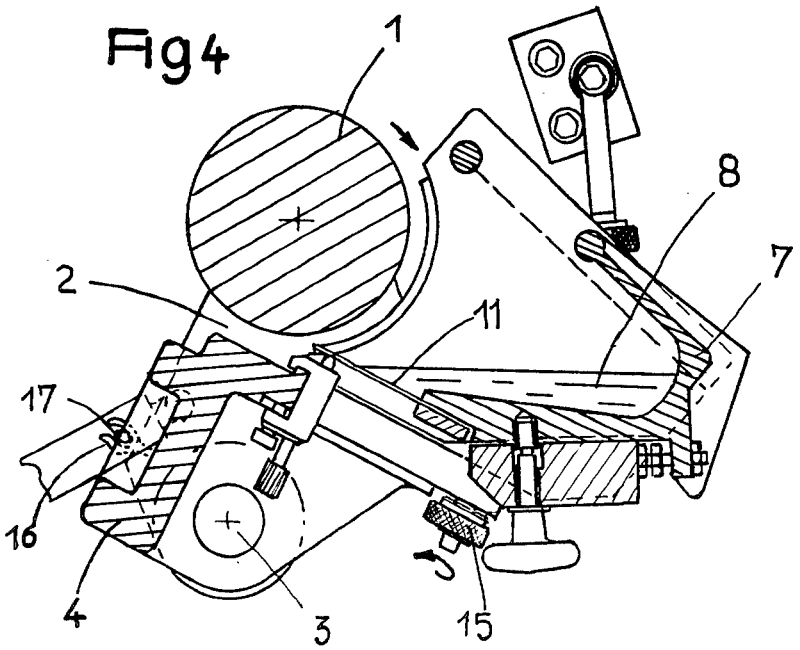
FIG. 4 is a figure similar to FIG. 3, after an additional pivoting of the ink duct about its own axis, in order to release the trough from the roller.

Reference will now be made to FIG. 4, which shows the pivoting of the ink duct 4 about its axis 3, the latter now remaining fixed because the bearing 2 has been hooked to the fixed frame 13 by means of the clip 16. In order to permit the pivoting of the ink duct 4 about its axis 3, the ink duct 4 has of course been unhooked from the bearing 2 by slackening the screw 15. In the position reached after pivoting about the axis 3, the ink duct 4 is such that the trough 7 moves away from the roller 1 and thus assumes a position in which it can easily be withdrawn since the roller is now no longer necessary for the retention of the ink 8 in the trough 7. In this position, the blade 11 may also easily be cleaned.

Figure 5:
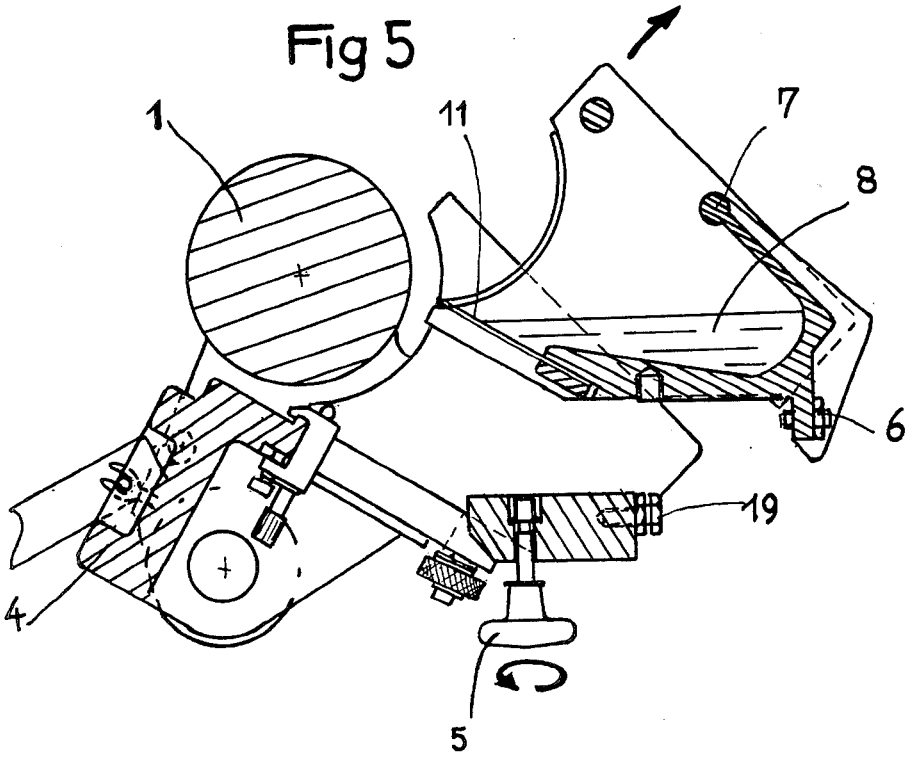
FIG. 5 is a figure similar to FIG. 4, showing the removal or the positioning of a trough.

The removal of the trough 7 is illustrated in FIG. 5. This is effected very simply, once the trough 7 has been detached from the ink duct 4 by fully slackening the screw 5. The trough 7 can thus be withdrawn and replaced by another similar trough containing an ink of a different color. The new trough which will replace the trough 7 may be of slightly different dimensions from the first one; this is why a precise positioning of the trough 7 on the ink duct 4 has been provided by a double adjustment effected by means of the screws 6 and 19. This adjustment need not be performed every time a trough 7 is mounted on an ink duct 4. Indeed, the adjustment of the screw 6 is performed once and for all on each trough 7 so that the distance between the end of the blade 11 and the bearing face of the screw 6 is identical for all the troughs 7, and the adjustment of the screw 19 is performed once and for all on each ink duct 4 so that the distance between the roller 1 and the bearing face of the screw 19 is identical for all the ink ducts 4. When any trough 7 is positioned on any ink duct 4, already adjusted, it is therefore sufficient to screw the screw 6 into the screw 19 without any need to perform a fresh adjustment. The fixing of the trough 7 to the ink duct 4 is of course completed by the screwing of the screw 5.

The invention which has just been described permits easy changing of the troughs of the ink duct of a low-blade type inking mechanism, without necessitating adjustment at each change of trough. It also permits the ink duct blade to be cleaned easily.

Obviously, the invention is not limited to the embodiment which has just been described, purely by way of example, but it likewise covers embodiments which might differ therefrom solely as to detail, as to variants of construction or as to the use of equivalent means.

Thus any number of troughs may obviously be supported by the ink duct, this number depending upon the number of pages required to be printed simultaneously.

We claim:

1. A low-blade type inking mechanism comprising an ink duct roller (1) and an ink duct (4), a pivot axis parallel to said roller, said ink duct being mounted on said pivot axis for rotation about said pivot axis, said ink duct carrying at least one detachable trough (7), containing ink and having an edge contacting said ink duct roller, means to enable removal of said trough from said ink duct without loss of any ink contained in said trough, said means including means to move said pivot axis along a path concentric with the axis of said ink duct roller without moving said edge of said trough which contacts said ink duct roller out of contact with said ink duct roller to thereby tilt said trough so that the ink contained therein moves away from said edge of said trough which contacts said ink duct roller, said ink duct being rotatable about said pivot axis to provide clearance and thereby enable said trough to be removed from said ink duct.

2. An inking mechanism as claimed in claim 1, which is equipped with means (18) to rotate the axis (3) of the ink duct (4) about the axis of the roller (1) between two positions, a so-called work position in which the ink (8) contained in the trough (7) of the ink duct (4) wets the ink duct roller (1) (FIG. 1) and a position in which the end of the ink duct blade (11) emerges from the ink (8) contained in the trough (7) (FIG. 3).

3. An inking mechanism as claimed in claim 1, wherein the means (6 and 19) of fixing the trough (7) to the ink duct (4) are adjustable to permit the permutation of different detachable troughs (7) to different ink ducts (4).

4. An inking mechanism as claimed in claim 2, wherein the means (6 and 19) of fixing the trough (7) to the ink duct (4) are adjustable to permit the permutation of different detachable troughs (7) to different ink ducts (4).

* * * * *